US005088139A

United States Patent [19]

Bloom

[11] Patent Number: 5,088,139

[45] Date of Patent: Feb. 18, 1992

[54] PORTABLE INFANT'S PLAY MAT WITH INTEGRAL CARRYING CASE

[75] Inventor: Stuart J. Bloom, Marlborough, Mass.

[73] Assignee: Pockets of Learning, Sudbury, Mass.

[21] Appl. No.: 739,668

[22] Filed: Aug. 2, 1991

[51] Int. Cl.[5] ..... A47D 3/00; A47D 13/06; A47C 21/08

[52] U.S. Cl. ..... 5/420; 190/1; 190/2

[58] Field of Search ..... 5/420, 417, 418, 419, 5/424, 425; 190/1, 2; 383/4

[56] References Cited

U.S. PATENT DOCUMENTS

| | | | |
|---|---|---|---|
| 2,626,407 | 1/1953 | Kurry | 5/99.1 |
| 2,738,834 | 3/1956 | Jaffe et al. | 5/420 |
| 3,968,911 | 7/1976 | Haas | 5/424 |
| 4,375,111 | 3/1983 | Hall | 5/420 |
| 4,734,948 | 4/1988 | Danova | 5/420 |
| 4,774,734 | 10/1988 | Mills | 5/413 |
| 4,788,726 | 12/1988 | Rafalko | 5/424 |
| 5,035,013 | 7/1991 | Bloom | 5/420 |

FOREIGN PATENT DOCUMENTS

| | | | |
|---|---|---|---|
| 1209228 | 2/1960 | France | 5/420 |

*Primary Examiner*—Alexander Grosz
*Attorney, Agent, or Firm*—Hamilton, Brook, Smith & Reynolds

[57] ABSTRACT

A portable infant's play mat has a cushioned base portion and a cushioned wall portion which follows the perimeter of the base portion. Securing means are provided to removably secure the wall portion to the base portion. The base portion is foldable along a fold line. The mat has flaps attached to the underside of the base portion, the open sides of which are securable together with a zipper. With the mat in a folded position, the flaps may be turned inside out such that each encases a portion of the mat. The flaps when inside out and secured together thus form an integral carrying case. With the flaps inside out, a shoulder strap is exposed for easy carrying of the enclosed mat.

5 Claims, 3 Drawing Sheets

PORTABLE INFANT'S PLAY MAT WITH INTEGRAL CARRYING CASE

RELATED APPLICATION

This invention is an improvement of that presented in application Ser. No. 07/538,237, filed June 14, 1990 now U.S. Pat. No. 5,035,013.

BACKGROUND OF THE INVENTION

Mats of various types, both quilted and unquilted, plain and decorated are well known in the prior art. Mats which may be folded or rolled for portability and used as a floor covering upon which to place infants have also been shown. Diaper changing mats exist with permanently attached low walls of quilted material which serve to prevent articles from sliding or rolling off the mat.

SUMMARY OF THE INVENTION

In accordance with the present invention an infant's play mat is provided which has a cushioned base portion. A cushioned wall portion follows the perimeter of the base portion, and securing means are provided to removably secure the base portion to the wall portion, allowing the two portions to be separated. In a preferred embodiment the wall portion is secured to the base portion with a zipper. The size of the wall portion is made large enough such that when the play mat is in an open position the wall portion creates a psychological barrier which inhibits an infant on the mat from straying from the mat. Both the base portion and the wall portion are preferably fabric with fiber or foam batting inside. In a preferred embodiment the outer fabric is a smooth material such as nylon.

The mat is foldable to allow it to be transported in a compact form. In the preferred embodiment the base portion has a stitch line which attaches a bottom piece of outer fabric to the foam batting. The somewhat square stitching through the batting material creates four lines along which the mat tends to fold. Fasteners may be supplied along the surface of the wall portion positioned opposite each other and relative to four sides of the mat, such that they meet and keep opposite sides of the wall portion secured to one another when the mat is in a folded position. In one embodiment the fasteners are patches of hook and pile cloth, which allows the alternative of removably attaching objects to the patches of hook and pile cloth when the mat is in an open position.

In the preferred embodiment, the mat has an integral carrying case. Stitched to the mat (preferably on the bottom) is a pocket comprising an extra piece of outer material divided into a first flap and a second flap, each attached to the base portion along a substantial portion of the perimeter of the flap. A zipper or other fastening means is provided to fasten the first flap to the second flap to secure the pocket in a closed position. In the preferred embodiment, the flaps of the pocket are stitched to the base along the stitch lines defining the fold lines of the mat. Each flap has an initial position in which it is adjacent the lower fabric surface of the base portion. In this position, an opening between the first flap and the lower fabric surface faces an opening between the second flap and the lower fabric surface, such that when the flaps are fastened to one another as by a zipper, a region between the flaps and the lower fabric surface is enclosed.

When the mat is in a folded position, the flaps of the pocket are turned inside out to a reversed position in which each encloses a substantial portion of the folded mat. With both flaps meeting in the reversed position, the zipper is closed to fully enclose the folded mat. In the preferred embodiment, a shoulder strap is exposed when the mat is enclosed. The locations at which the strap connects to the mat are between the pocket and the underside of the base portion. Thus, with the mat in the open position, the flaps of the pocket may be fastened together in their respective initial positions to enclose the strap. Preferably, the strap is connected to the mat at two points along the stitch line attaching the bottom fabric piece to the foam batting.

DETAILED DESCRIPTION OF THE PREFERRED EMBODIMENT

Figure 1:
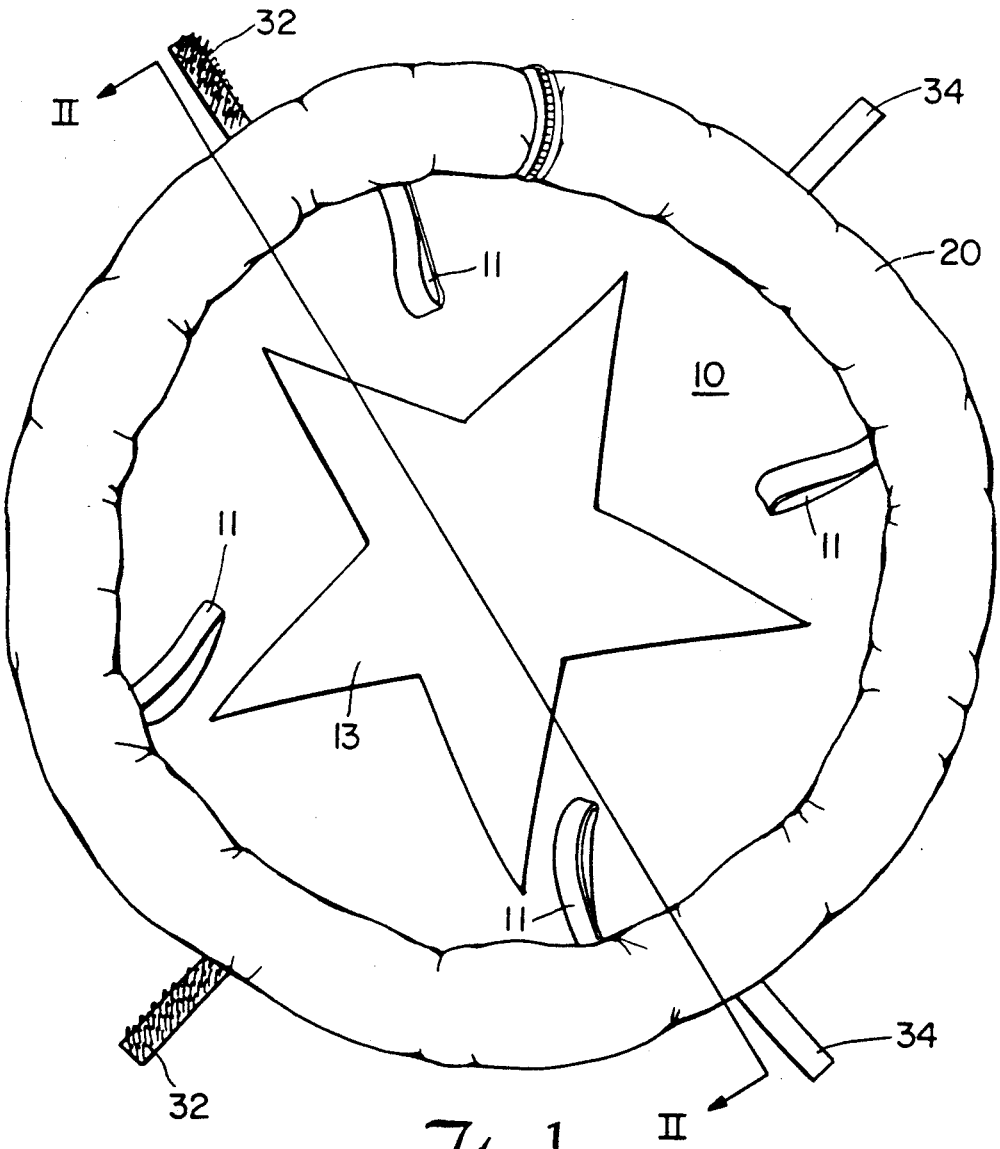
FIG. 1 is a plan view of the invention showing the play mat in its unfolded configuration.

The play mat is shown from the top in its unfolded configuration in FIG. 1. Base portion 10 is surrounded by wall portion 20, to which are attached Velcro® "hook" strips 32 and Velcro® loopstrips 34. Velcro® is a trademark for hook and pile cloth registered to Velcro USA. Hook strips 32 are positioned such that the upper side of a hook strip meets the underside of the loop strip to fasten opposite sides of the mat together. In this way, the play mat is held in a folded position.

Also shown in FIG. 1 are optional loop straps 11 each having one side sewn to the periphery of the base portion. The opposite end of each loop strap 11 has a section of Velcro® material which attaches to an opposing section of Velcro® material when the strap 11 is folded over on itself (as shown in the figure). Toys or other infant needs may be safely attached to the loop straps 11. An optional applique 13 is also shown in the figure, and may be sewn or otherwise affixed to the surface of the base portion 10 for aesthetic purposes.

Figure 2:
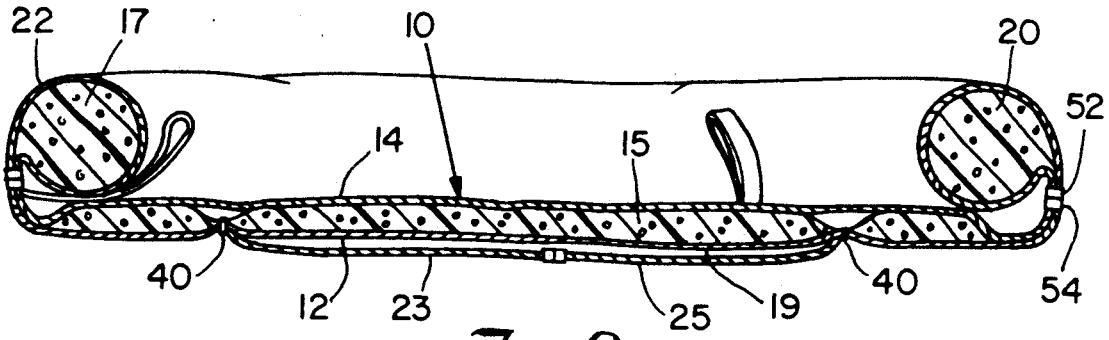
FIG. 2 is a sectional view of the invention viewed along section line II—II of FIG. 1.

The construction of the play mat is illustrated in FIG. 2, which is a sectional view taken along section line II—II of FIG. 1. Base 10 is constructed of bottom fabric sheet 12 and top fabric sheet 14 containing fiber or foam batting 15 between them. In a preferred configuration, base 10 has stitching through the batting and bottom fabric sheet 12 which defines stitch line 40. Wall 20 is constructed of fabric shell 22 containing similar fiber or foam batting 17, and is removably attached to base 10 by means of zipper strip 52, which is zipped to mating zipper strip 54 sewn to base 10. By unzipping zipper 52-54, wall 20 may be detached from base 10 for purposes of washing or to create a sleeping mat out of base 10 alone. Also shown in FIG. 2 is pocket 19 which will be discussed in detail hereinafter.

Infant mats in the past have provided low walls surrounding a base mat. However, these walls did not provide a sufficient psychological barrier to keep the infant on the mat. The present invention takes this into consideration by providing wall 20 which is high enough and wide enough that an infant feels compelled to stay on the play mat 10.

In the preferred embodiment, the base 10 has a diameter of about 36 inches and a height of up to about 2 inches. The wall 20 is toroidally shaped with a cross sectional diameter of about 4 inches. The wall has an outside diameter which is greater than that of the base 10 such that the overall circumference of the play mat is defined by the outer circumference of the wall. When in an open position, the wall 20 extends about 3–4 inches above the top surface of the base 10, and the overall circumference of the wall in the open position is about 114 inches. The size of the wall 20 provides the necessary psychological barrier to help keep an infant on the mat from crawling out.

Figure 3:
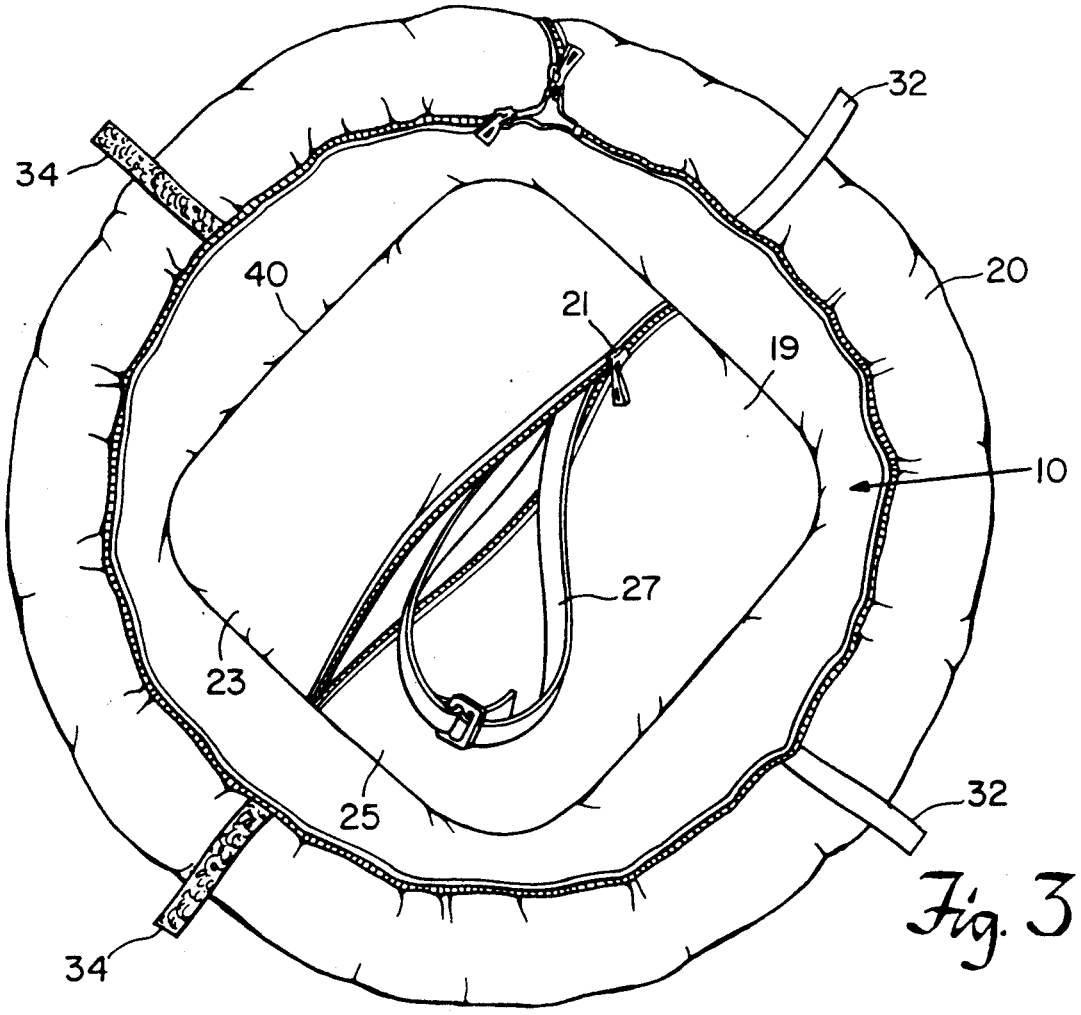
FIG. 3 is a bottom view of the play mat.

FIG. 3 is a bottom view of the play mat showing the zipper connection between base portion 10 and wall portion 20. Clearly shown in the FIG. 3 view is the somewhat square shape of stitch line 40, which secures the batting 15 of the base portion 10 to the bottom fabric sheet 12. The stitching of the stitch line does not extend through to the top surface of the base portion, and thus does not form any rough areas on the otherwise soft, smooth top surface. However, the collapse of the batting in the area of the stitch lines results in natural fold lines along the four sides of the square shape defined. The base of the mat tends to fold along these fold lines when the sides of the mat are brought toward its center.

The stitch line 40 also serves to secure pocket material 19 to the base portion 10. Shown also in FIG. 2, the pocket material 19 consists of flaps 23, 25 and creates a pocket region between material 19 and bottom sheet 12. Zipper 21 joins the two flaps 23 and 25 of the pocket 19. Other securing means may also be used as an alternative to the zipper. With the mat in the open position of FIG. 3, the flaps 23, 25 are each in an initial position, and the zipper may be closed such that the pocket encloses carrying strap 27.

Figure 4:
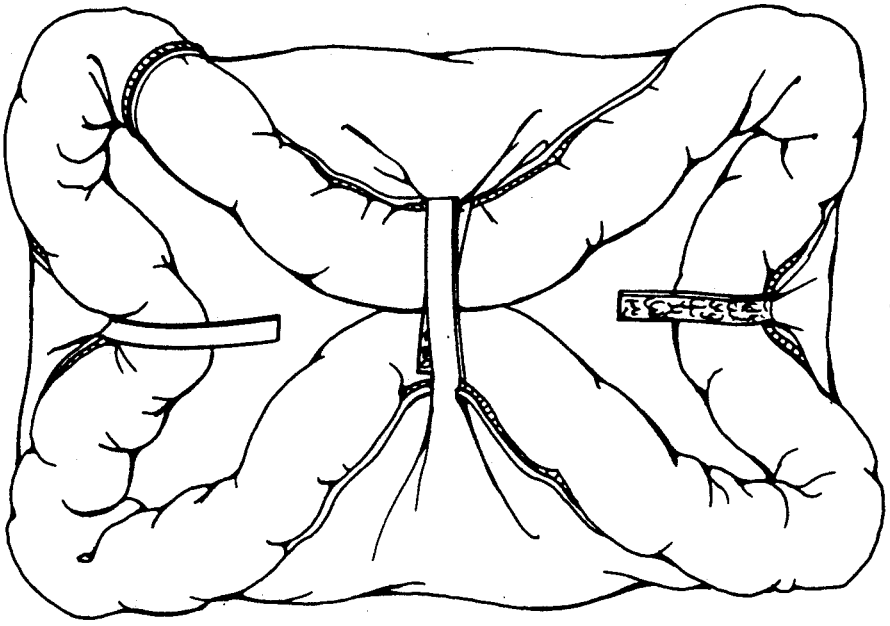
FIG. 4 is a top view of the mat in a partially folded position.

When the mat is to be transported, the sides of the mat are folded inward. The top view of FIG. 4 shows the sides of the mat folded in along the fold lines defined by stitch line 40. In the figure, two of the four straps 32, 34 are fastened together. The remaining two straps are similarly fastened together before the mat is packaged for travel. Since all four sides fold in along the fold lines defined by substantially square stitch line 40, the folded and secured mat has a somewhat square shape.

To package the folded mat in its integral carrying case, the two flaps 23, 25 of the pocket material 19 are turned inside out such that they are each in a reversed position and enclose the folded mat. Since each flap 23, 25 of the pocket is attached along three sides to stitch line 40, the flaps easily enclose the mat, which is folded along the same line.

Figure 5:
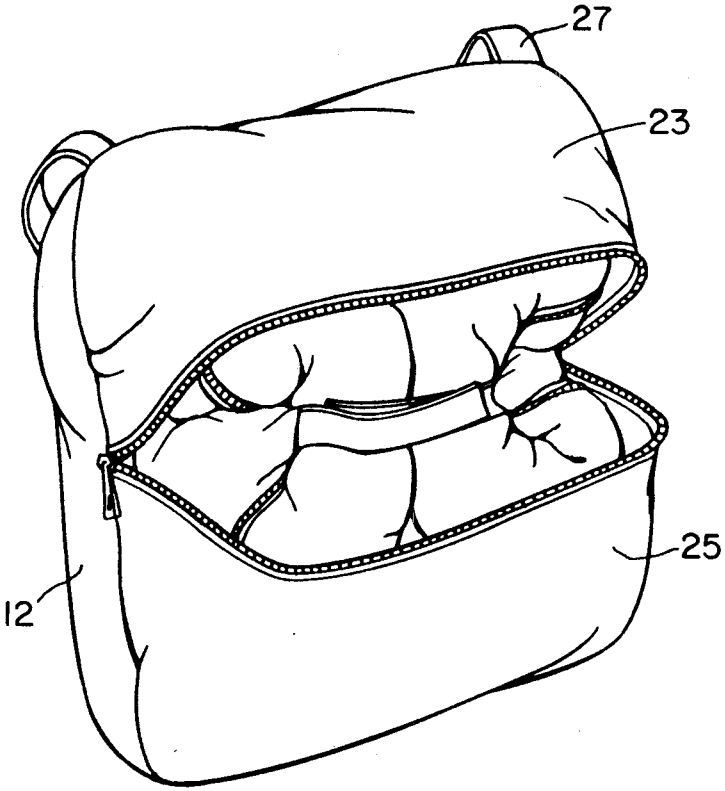
FIG. 5 is a perspective view of the play mat with its integral pocket reversed to enclose the folded mat.

FIG. 5 shows the mat with pocket flaps 23, 25 turned inside out. As shown, the portion of bottom sheet 12 which is covered by flaps 23, 25 when the mat is in the open position, is now exposed and represents an outside surface of the formed integral carrying case. The zipper 21 is reversible, having a handle on each side. Thus, in the position shown in FIG. 5, the zipper may be closed to seal the carrying case, fully enclosing the remainder of the mat.

Figure 6:
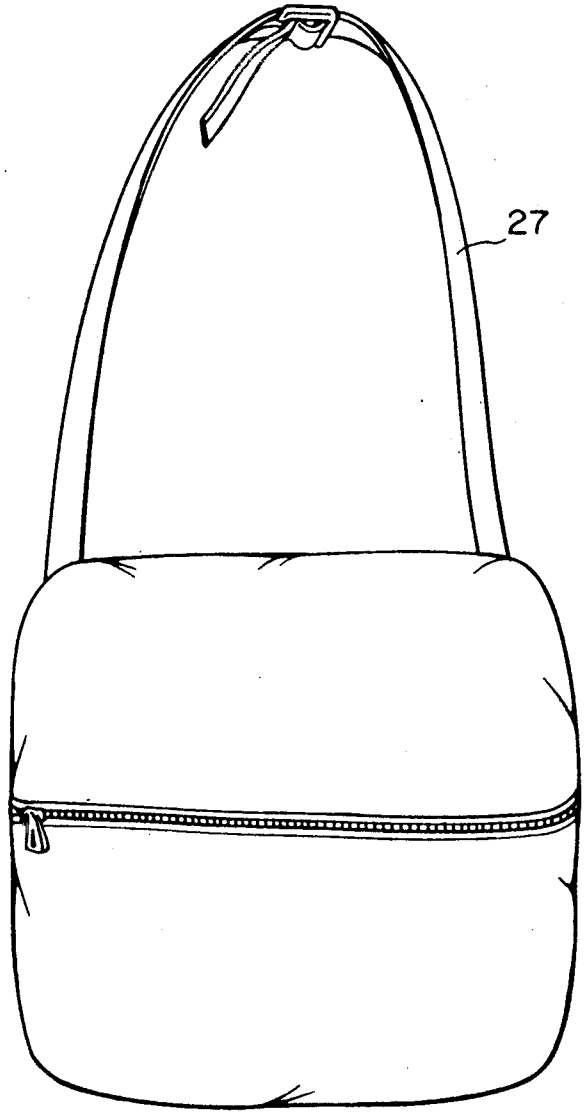
FIG. 6 is a front view of the mat enclosed in the integral pocket showing the carrying strap.

FIG. 6 shows the mat in the closed state, ready for transport. The carrying strap 27 is now fully exposed. In the preferred embodiment, the two ends of the strap are sewn to the mat at stitch line 40, such that the strap supports the mat in the upright position shown in FIG. 6. A buckle is provided so that the length of strap 27 may be adjusted. The strap is made long enough so that it may be used as a convenient shoulder strap.

While the invention has been particularly shown and described with reference to a preferred embodiment thereof, it will be understood by those skilled in the art that various changes in form and detail may be made therein without departing from the spirit and scope of the invention as defined by the appended claims.

I claim:

1. An infant's play mat comprising:

a cushioned foldable base portion defined by a top fabric layer, a bottom fabric layer and a cushioning material located between said top and bottom layers;

a cushioned wall portion following the perimeter of the base portion and being releasably connected thereto by separable fastener means;

connecting straps attached to opposite sides of the mat and securable to each other when said opposite sides of the mat are folded toward each other;

a somewhat square-shaped stitching pattern in the base portion comprising stitches connecting the cushioning material to the bottom fabric layer, said stitching pattern defining a fold line facilitating the of folding of the play mat;

a first flap stitched to the bottom fabric layer of the base portion along a substantial portion of the perimeter of the first flap such that in an initial flap position, a surface of the first flap is adjacent to the bottom fabric layer of the base portion, and in a reversed flap position inside out relative to the initial flap position, a substantial portion of the mat is encased between the first flap and the bottom fabric layer;

a second flap stitched to the bottom fabric layer of the base portion along a substantial portion of the perimeter of the second flap, the second flap being located adjacent the first flap and the base portion such that with the first flap and the second flap each in a reversed position, a first substantial portion of the mat is encased between the first flap and the bottom fabric layer of the base portion and a second substantial portion of the mat is encased between the second flap and the bottom fabric layer of the base portion, wherein said somewhat square-shaped stitching pattern stitches said first flap and said second flap to the bottom fabric layer; and a fastener for fastening the first flap to the second flap when each is in a reversed position, such that the first substantial portion of the mat and the second substantial portion of the mat are substantially fully enclosed between the bottom fabric layer of the base portion and the first and second flaps.

2. A play mat according to claim 1 wherein the fastener for fastening the first flap to the second flap is a zipper.

3. A play mat according to claim 1 further comprising a carrying handle secured to the play mat.

4. A play mat according to claim 3 wherein the handle is enclosed between the first and second flaps and the base portion when the first and second flaps are fastened together with each flap in an initial position.

5. A play mat according to claim 1 wherein the cushioning matierial is a foam batting layer.

* * * * *